US009879560B2

(12) United States Patent
Dibenedetto et al.

(10) Patent No.: US 9,879,560 B2
(45) Date of Patent: Jan. 30, 2018

(54) VANE STRUT POSITIONING AND SECURING SYSTEMS

(71) Applicant: UNITED TECHNOLOGIES CORPORATION, Farmington, CT (US)

(72) Inventors: Enzo Dibenedetto, Kensington, CT (US); Matthew E. Bintz, West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 280 days.

(21) Appl. No.: 14/712,999

(22) Filed: May 15, 2015

(65) Prior Publication Data

US 2016/0333726 A1 Nov. 17, 2016

(51) Int. Cl.
*F01D 17/14* (2006.01)
*F01D 9/02* (2006.01)
(Continued)

(52) U.S. Cl.
CPC ..... *F01D 17/14* (2013.01); *F01D 9/02* (2013.01); *F01D 9/042* (2013.01); *F01D 17/162* (2013.01);
(Continued)

(58) Field of Classification Search
CPC ..... F01D 9/00; F01D 9/02; F01D 9/04; F01D 9/041; F01D 9/042; F01D 25/162;
(Continued)

(56) References Cited

U.S. PATENT DOCUMENTS 3,788,763 A * 1/1974 Nickles ..... F04D 29/563 415/147
3,990,810 A 11/1976 Amos et al.
(Continued)

FOREIGN PATENT DOCUMENTS

| | | |
|---|---|---|
| EP | 1340894 A2 | 9/2003 |
| FR | 2908828 A1 | 5/2008 |
| GB | 774501 A | 5/1957 |

OTHER PUBLICATIONS

English Translation for Abstract FR2908828.
English Translation of Specification and Claims for FR2908828.
European Search Report for Application No. EP 16 16 0455.

*Primary Examiner* — Nathaniel Wiehe
*Assistant Examiner* — Elton Wong
(74) *Attorney, Agent, or Firm* — Cantor Colburn LLP

(57) ABSTRACT

A strut-flap vane system for a turbomachine includes a vane strut comprising an airfoil portion and a strut mount extending in a radially outward direction from the airfoil portion. The strut mount forms a hollow semi-cylinder and includes threading on an outer diameter thereof. The system includes an aft mount portion or portions defining a hollow semi-cylinder configured to form a strut cylinder with the strut mount such that the aft mount portion can be disposed in contact with the strut mount to form the strut cylinder. The strut cylinder defines a cylinder opening and the aft mount portion includes threading on an outer diameter thereof that aligns with the threading of the strut mount to allow a strut spanner nut to mesh with both the strut mount and the mount portion.

19 Claims, 4 Drawing Sheets

(51) Int. Cl.
*F01D 9/04* (2006.01)
*F01D 17/16* (2006.01)

(52) U.S. Cl.
CPC .... *F05D 2220/323* (2013.01); *F05D 2230/60* (2013.01)

(58) Field of Classification Search
CPC ..... F01D 17/12; F01D 17/14; F01D 17/162; F05D 2230/60; F05D 2230/70
See application file for complete search history.

(56) References Cited

U.S. PATENT DOCUMENTS

| | | | | |
|---|---|---|---|---|
| 5,328,327 | A * | 7/1994 | Naudet | F01D 17/162 29/889.22 |
| 2011/0110783 | A1* | 5/2011 | Addis | B23P 6/005 416/219 R |
| 2012/0163960 | A1* | 6/2012 | Ress, Jr. | F01D 17/162 415/173.1 |

* cited by examiner

VANE STRUT POSITIONING AND SECURING SYSTEMS

STATEMENT OF GOVERNMENT RIGHTS

This invention was made with government support under contract no. FA-8650-09-D-2923-0021 awarded by the Air Force. The government has certain rights in the invention.

BACKGROUND

1. Field

The present disclosure relates to turbomachine vanes, more specifically to mounting systems for vane struts.

2. Description of Related Art

In certain gas turbine engines, a plurality of variable vanes having a strut-flap design can be utilized to properly direct air flow to downstream airfoils which can enhance performance. The gap between the upstream strut and the downstream flap of each vane typically needs to be very small to prevent unacceptable leakage from the high pressure side to the low pressure side thereof. This can be achieved by individual custom fabrication having very low tolerances, but such solutions are not proven cost effective in a production environment.

Such conventional methods and systems have generally been considered satisfactory for their intended purpose. However, there is still a need in the art for improved strut positioning and securement systems. The present disclosure provides a solution for this need.

SUMMARY

A strut-flap vane system for a turbomachine includes a vane strut comprising an airfoil portion and a strut mount extending in a radially outward direction from the airfoil portion. The strut mount forms a hollow semi-cylinder and includes threading on an outer diameter thereof. The system includes an aft mount portion or portions defining a hollow semi-cylinder configured to form a strut cylinder with the strut mount such that the aft mount portion can be disposed in contact with the strut mount to form the strut cylinder. The strut cylinder defines a cylinder opening and the aft mount portion includes threading on an outer diameter thereof that aligns with the threading of the strut mount to allow a strut spanner nut to mesh with both the strut mount and the mount portion.

In a further embodiment of any of the foregoing embodiments, the flap mount assembly may additionally and/or alternatively be disposed within the cylinder opening and can have a flap post extending from a flap and rotatable relative to the strut cylinder to allow the flap to change position relative to the vane strut.

In a further embodiment of any of the foregoing embodiments, the flap mount assembly may additionally and/or alternatively include a bushing disposed around the flap post, the bushing including threading on an outer diameter thereof.

In a further embodiment of any of the foregoing embodiments, the bushing may additionally and/or alternatively include a bushing flange disposed radially inward of the strut cylinder.

In a further embodiment of any of the foregoing embodiments, the system may additionally and/or alternatively include a flap spanner nut meshed with the threading on the bushing to secure the bushing and the flap in a position relative to the strut while allowing the flap post to rotate.

In a further embodiment of any of the foregoing embodiments, the flap spanner nut may additionally and/or alternatively be sized to fit at least partially within the cylinder opening and engage with a cylinder flange extending from the strut cylinder.

In a further embodiment of any of the foregoing embodiments, the flap spanner nut may additionally and/or alternatively include anti-rotation serrations on a surface thereof that contacts the cylinder flange to prevent rotation of the spanner nut after compressing against the cylinder flange.

In a further embodiment of any of the foregoing embodiments, the system may additionally and/or alternatively include a strut spanner nut configured to mount the strut-flap vane to a turbomachine housing.

In a further embodiment of any of the foregoing embodiments, the strut spanner nut may additionally and/or alternatively include anti-rotation serrations on a surface thereof that contacts the turbomachine housing.

A vane strut for a strut-flap vane can include an airfoil portion and a strut mount extending in a radially outward direction from the airfoil portion, wherein the strut mount forms a hollow semi-cylinder and includes threading on an outer diameter thereof.

In a further embodiment of any of the foregoing embodiments, the vane strut may additionally and/or alternatively include an aft mount portion as described above removably attached to the strut mount.

A method includes assembling a flap mount assembly, placing a flap mount assembly proximate to a strut mount of a strut, and disposing an aft mount portion around the flap mount assembly such that the aft mount portion and the strut mount form a strut cylinder with threading on an outer diameter thereof.

In a further embodiment of any of the foregoing embodiments, the assembling the flap mount assembly may additionally and/or alternatively include disposing a bushing around a flap post of a flap such that the flap post is attached to the bushing but rotatable relative to the bushing.

In a further embodiment of any of the foregoing embodiments, the method may additionally and/or alternatively include disposing a washer between a portion of the bushing and a portion of the flap.

In a further embodiment of any of the foregoing embodiments, the method may additionally and/or alternatively include securing the flap mount assembly to the strut cylinder by threading a flap spanner nut around the bushing and tightening the flap spanner nut into a flange of the strut cylinder.

In a further embodiment of any of the foregoing embodiments, the method may additionally and/or alternatively include placing the strut cylinder within a turbomachine housing.

In a further embodiment of any of the foregoing embodiments, the method may additionally and/or alternatively include securing the strut cylinder to the turbomachine housing by threading a strut spanner nut around the strut cylinder and tightening the strut spanner nut into the turbomachine housing.

In a further embodiment of any of the foregoing embodiments, the flap mount assembly may additionally and/or alternatively be secured to the strut cylinder before the strut cylinder is secured to the turbomachine housing.

In a further embodiment of any of the foregoing embodiments, the method may additionally and/or alternatively include positioning the flap relative to the vane strut before securing the flap mount assembly to the strut cylinder.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
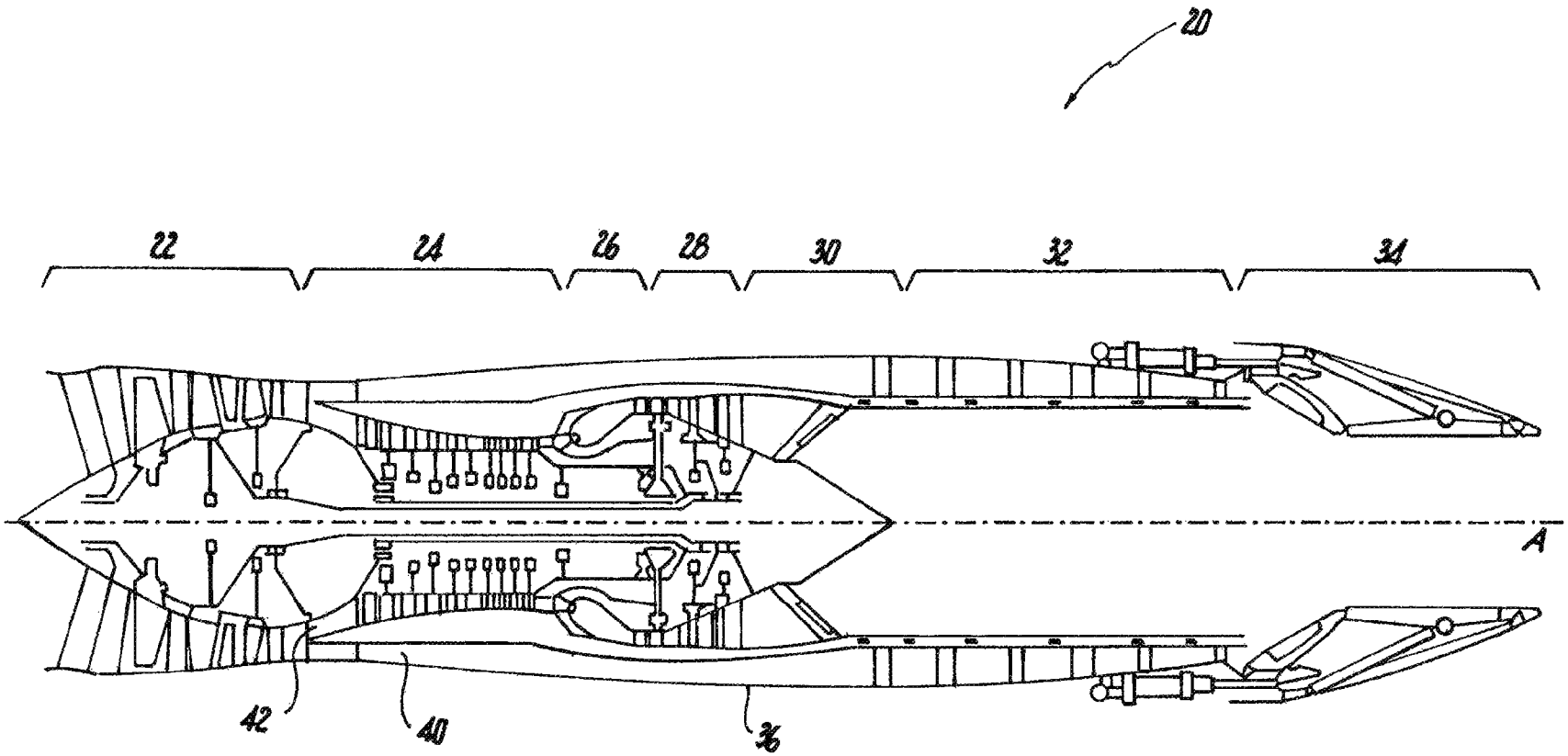
FIG. 1 is a schematic view of an embodiment of a turbomachine in accordance with this disclosure.
Figure 2:
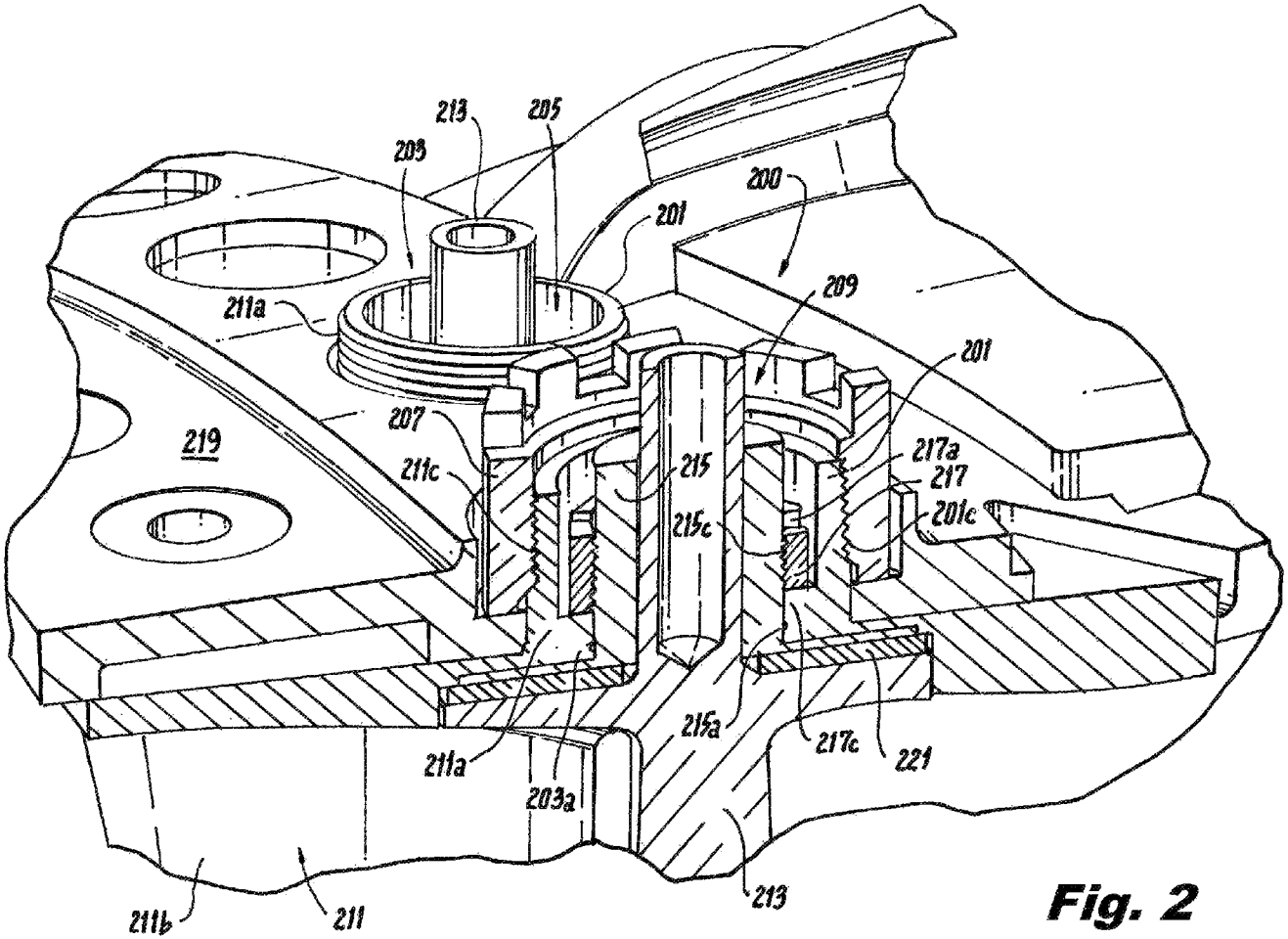
FIG. 2 is a cross-sectional view of a portion of an embodiment of a system in accordance with this disclosure, showing an embodiment of a vane strut and flap mounting assembly attached to a housing.
Figure 3:
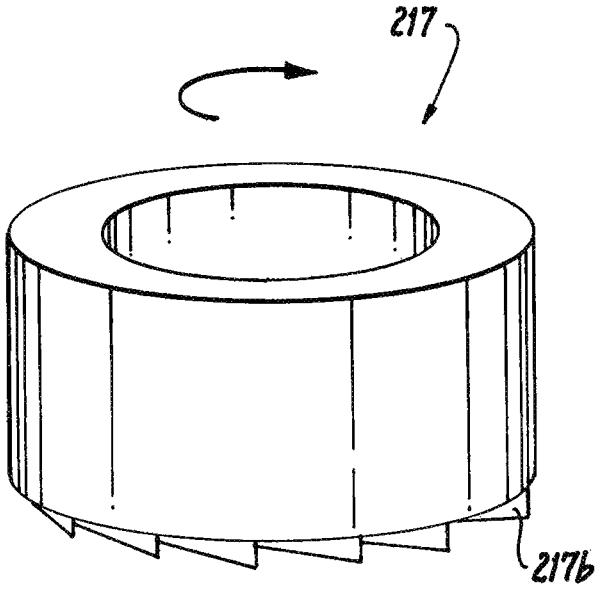
FIG. 3 is a perspective view of an embodiment of a spanner nut in accordance with this disclosure.
Figure 4:
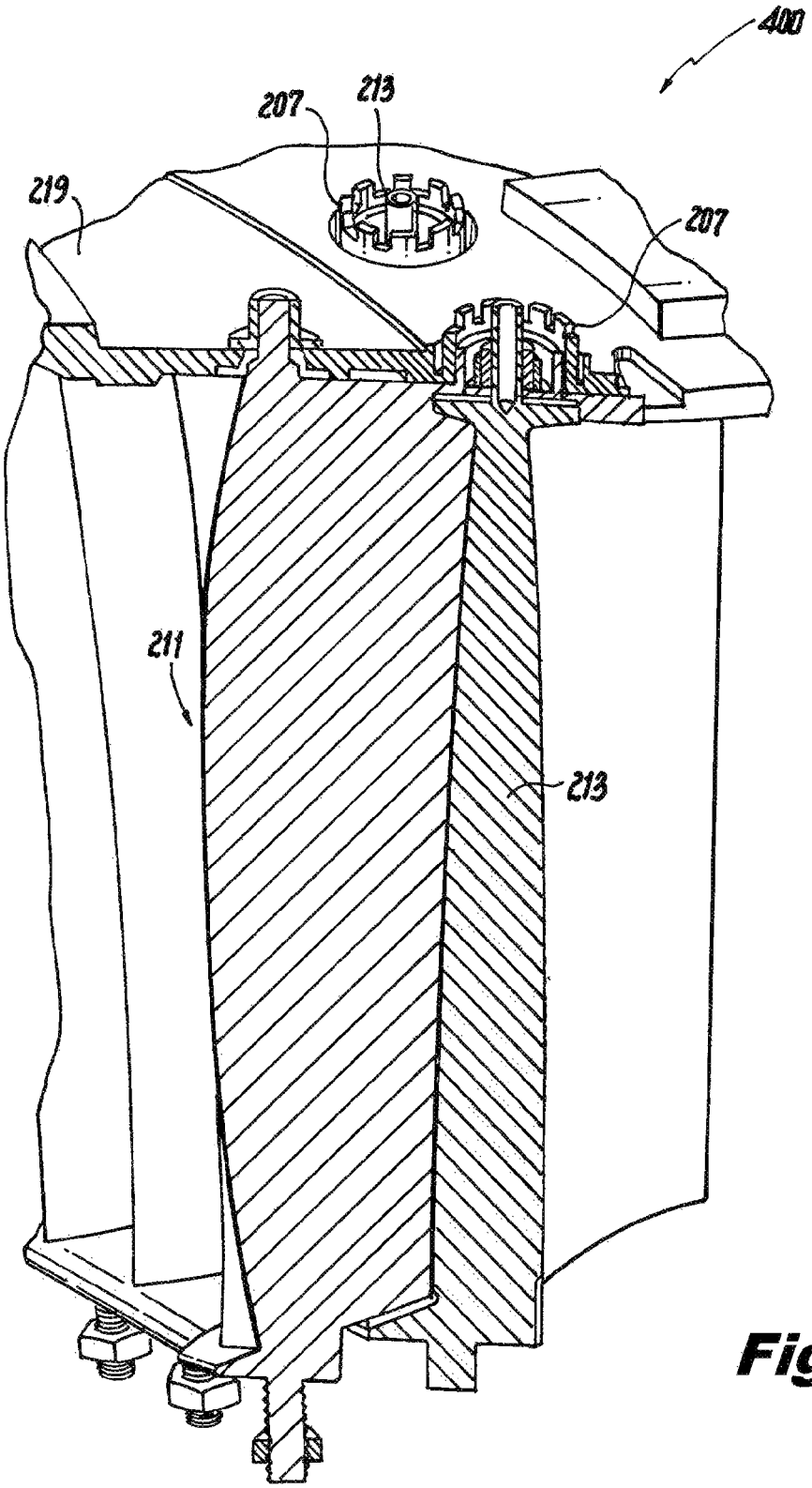
FIG. 4 is a perspective view of an embodiment of a strut-flap vane in accordance with this disclosure, showing an embodiment of a strut washer disposed thereon.

Reference will now be made to the drawings wherein like reference numerals identify similar structural features or aspects of the subject disclosure. For purposes of explanation and illustration, and not limitation, an illustrative view of an embodiment of a system in accordance with the disclosure is shown in FIG. 2 and is designated generally by reference character 200. Other embodiments and/or aspects of this disclosure are shown in FIGS. 1, 3, and 4. The systems and methods described herein can be used to mount a strut-flap vane to a turbomachine housing.

FIG. 1 schematically illustrates an embodiment of a gas turbine engine 20. The gas turbine engine 20 is disclosed herein as a two-spool low-bypass augmented turbofan that generally incorporates a fan section 22, a compressor section 24, a combustor section 26, a turbine section 28, an augmenter section 30, an exhaust duct section 32, and a nozzle system 34 along a central longitudinal engine axis A. Although depicted as an augmented low bypass turbofan in the disclosed non-limiting embodiment, it should be understood that the concepts described herein are applicable to other gas turbine engines including non-augmented engines, geared architecture engines, direct drive turbofans, turbojet, turboshaft, multi-stream variable cycle adaptive engines and other engine architectures. Variable cycle gas turbine engines power aircraft over a range of operating conditions and essentially alter a bypass ratio during flight to achieve countervailing objectives such as high specific thrust for high-energy maneuvers yet optimize fuel efficiency for cruise and loiter operational modes.

An engine case structure 36 defines a generally annular secondary airflow path 40 around a core airflow path 42. It should be appreciated that various components, individually and collectively, may define the engine case structure 36 that essentially defines an exoskeleton to support the rotational hardware.

Air that enters the fan section 22 is divided between a core airflow through the core airflow path 42 and a secondary airflow through a secondary airflow path 40. The core airflow passes through the compressor section 24, combustor section 26, the turbine section 28, then the augmentor section 30 where fuel may be selectively injected and burned to generate additional thrust through the nozzle system 34. It should be appreciated that additional airflow streams such as third stream airflow typical of variable cycle engine architectures may additionally be sourced from the fan section 22.

The secondary airflow may be utilized for a multiple of purposes to include, for example, cooling and pressurization. The secondary airflow as defined herein may be any airflow different from the core airflow. The secondary airflow may ultimately be at least partially injected into the core airflow path 42 adjacent to the exhaust duct section 32 and the nozzle system 34.

The exhaust duct section 32 may be circular in cross-section as typical of an axisymmetric augmented low bypass turbofan or may be non-axisymmetric in cross-section to include, but not be limited to, a serpentine shape to block direct view to the turbine section 28.

In addition to the various cross-sections and the various longitudinal shapes, the exhaust duct section 32 may terminate in a Convergent/Divergent (C/D) nozzle system, a non-axisymmetric two-dimensional (2D) C/D vectorable nozzle system, a flattened slot nozzle of high aspect ratio or other nozzle arrangement.

Referring to FIG. 2, a strut-flap vane system 200 for a turbomachine includes a vane strut 211 comprising an airfoil portion 211*b* and a strut mount 211*a* extending in a radially outward direction from the airfoil portion 211*b*. The strut mount 211*a* forms a hollow semi-cylinder and includes threading 211*c* on an outer diameter thereof.

The system 100 also includes at least one aft mount portion 201 defining a hollow semi-cylinder configured to form a strut cylinder 203 with the strut mount 211*a* such that the aft mount portion 201 can be disposed in contact with the strut mount 211*a* to form the strut cylinder 203. The strut cylinder 203 defines a cylinder opening 205. The aft mount portion 201 includes threading 201*c* on an outer diameter thereof that aligns with the threading 211*c* of the strut mount 211*a* to allow a strut spanner nut 207 to mesh with both the strut mount 211*a* and the aft mount portion 201.

A flap mount assembly 209 can be disposed within the cylinder opening and can have a flap post 213*a* extending from a flap 213 and can be rotatable relative to the strut cylinder 203 to allow the flap 213 to change position relative to the vane strut 211. For example, the flap post 213*a* can be operatively connected to an actuator servo to rotate the position of the flap 213. This can allow for the camber of the vane to be modified during operation to enhance performance of the engine in different operational conditions.

The flap mount assembly 209 can include a bushing 215 disposed around the flap post 213*a*. The bushing 215 can be disposed on the flap post 213*a* such that bushing 215 is retained along the length of the flap post 213*a* but the flap post 213*a* can rotate relative to the bushing 215 (e.g., via one or more complementary ridges on the inner diameter of the bushing and the outer diameter of the flap post 213). The bushing 215 can include threading 215*c* on an outer diameter thereof. The bushing 215 can include a bushing flange 215*a* disposed radially inward of the strut cylinder 203. As shown, a suitable washer 221 can be disposed between the bushing flange 215*a*.

The system 200 can further include a flap spanner nut 217 having threading 217*c* meshed with the threading 215*c* on the bushing 215 to secure the bushing 215 and the flap 213 in a position relative to the strut 211 while allowing the flap post 213*a* to rotate. The flap spanner nut 217 can include crown notches 217*a* configured to allow a mating tool to torque the flap spanner nut 217 about the bushing 217.

As shown, the flap spanner nut 217 can be sized to fit at least partially within the cylinder opening 205 and engage with a cylinder flange 203*a* extending from the strut cylinder. It is contemplated that the flap spanner nut 217 can be sized to the same or greater diameter as the strut cylinder 203 and can contact the upper surfaces of the strut cylinder 203.

Referring to FIG. 3, the flap spanner nut 217 can include anti-rotation serrations 217*b* on a surface thereof that contacts the cylinder flange 203*a* to prevent rotation of the spanner nut 217 after compressing against the cylinder flange 203*a*. Any other suitable anti-rotation mechanism is contemplated herein (e.g., adhesive).

Referring to FIGS. 2 and 4, the system 200 can also include a strut spanner nut 207 configured to mount the strut-flap vane 400 to a turbomachine housing 219. The strut spanner nut includes threading 207*c* that meshes with threading 211*c* and 201*c* of the strut mount 211*a* and the aft mounting portion 201 to retain both to form the strut cylinder 203.

Similar to the flap spanner nut 217, the strut spanner nut 207 can include anti-rotation serrations (and/or any other suitable anti-rotation mechanism) on a surface thereof that contacts the turbomachine housing 219. Also, the strut spanner nut 207 can include crown notches 207*a* configured to allow a mating tool to torque the strut spanner nut 207 about the strut cylinder 203.

In accordance with a method includes assembling a flap mount assembly 209, placing a flap mount assembly 209 proximate to a strut mount 211*a* of a strut 211, and disposing an aft mount portion 201 around the flap mount assembly 209 such that the aft mount portion 201 and the strut mount 211*a* form a strut cylinder 203 with threading 211*c*, 201*c* on an outer diameter thereof. Assembling the flap mount assembly 209 can include disposing a bushing 215 around a flap post 213*a* of a flap 213 such that the flap post 213*a* is attached to the bushing 215 but is also rotatable relative to the bushing 215.

The method can further include disposing a washer 221 between a portion of the bushing 215 and a portion of the flap 213. The method can further include securing the flap mount assembly 209 to the strut cylinder 203 by threading a flap spanner nut 217 around the bushing 215 and tightening the flap spanner nut 217 into a flange 203*a* of the strut cylinder 203. The method can further include placing the strut cylinder 203 within a turbomachine housing 219.

The method can further include securing the strut cylinder 203 to the turbomachine housing 219 by threading a strut spanner nut 207 around the strut cylinder 203 and tightening the strut spanner nut 207 into the turbomachine housing 219. The flap mount assembly 209 can be secured to the strut cylinder 203 before the strut cylinder 203 is secured to the turbomachine housing 219 (e.g., at a work bench before installation into the turbomachine). The method can further include positioning the flap 213 relative to the vane strut 211 before securing the flap mount assembly 209 to the strut cylinder 203 (e.g., to reduce a gap between the vane 211 and the flap 213).

Embodiments as disclosed herein allow typical manufacturing tolerances to be utilized while providing the flexibility to tightly position the flap 213 relative to the strut 211 (e.g., at the bench before installation into the turbomachine). Thus, improved sealing can be realized at all conditions with standard tolerances whereas traditional systems required custom fabrication per strut-flap segment to achieve sealing through tight clearances.

The methods and systems of the present disclosure, as described above and shown in the drawings, provide for improved strut-flap vane mounting systems with superior properties including improved positioning with standard manufacturing tolerances. While the apparatus and methods of the subject disclosure have been shown and described with reference to embodiments, those skilled in the art will readily appreciate that changes and/or modifications may be made thereto without departing from the scope of the subject disclosure.

What is claimed is:

1. A strut-flap vane system for a turbomachine, comprising:

a vane strut comprising an airfoil portion and a strut mount extending in a radially outward direction from the airfoil portion, wherein the strut mount forms a hollow semi-cylinder and includes threading on an outer diameter thereof; and at least one aft mount portion defining a hollow semi-cylinder configured to form a strut cylinder with the strut mount such that the aft mount portion can be disposed in contact with the strut mount to form the strut cylinder, wherein the strut cylinder defines a cylinder opening, wherein the at least one aft mount portion includes threading on an outer diameter thereof that aligns with the threading of the strut mount to allow a strut spanner nut to mesh with both the strut mount and the at least one aft mount portion.

2. The system of claim 1, further comprising a flap mount assembly disposed within the cylinder opening, the flap mount assembly including a flap post extending from a flap and rotatable relative to the strut cylinder to allow the flap to change position relative to the vane strut.

3. The system of claim 2, wherein the flap mount assembly includes a bushing disposed around the flap post, the bushing including threading on an outer diameter thereof.

4. The system of claim 3, wherein the bushing includes a bushing flange disposed radially inward of the strut cylinder.

5. The system of claim 3, further comprising a flap spanner nut meshed with the threading on the bushing to secure the bushing and the flap in a position relative to the strut while allowing the flap post to rotate.

6. The system of claim 5, wherein the flap spanner nut is sized to fit at least partially within the cylinder opening and engage with a cylinder flange extending from the strut cylinder.

7. The system of claim 6, wherein the flap spanner nut includes anti-rotation serrations on a surface thereof that contact the cylinder flange to prevent rotation of the spanner nut after compressing against the cylinder flange.

8. The system of claim 7, wherein the strut spanner nut is configured to mount the strut-flap vane to a turbomachine housing.

9. The system of claim 8, wherein the strut spanner nut includes anti-rotation serrations on a surface thereof that contact the turbomachine housing.

10. A vane strut for a strut-flap vane, comprising:

an airfoil portion; and a strut mount extending in a radially outward direction from the airfoil portion, wherein the strut mount forms a hollow semi-cylinder and includes threading on an outer diameter thereof.

11. The vane strut of claim 10, further comprising an aft mount portion removably attached to the strut mount and defining a hollow semi-cylinder configured to form a strut cylinder with the strut mount such that the aft mount portion can be disposed in contact with the strut mount to form the strut cylinder, wherein the strut cylinder defines a cylinder opening, wherein the aft mount portion includes threading on an outer diameter thereof that aligns with the threading of the strut mount to allow a strut spanner nut to mesh with both the strut mount and the aft mount portion.

12. A method, comprising:

assembling a flap mount assembly;

placing the flap mount assembly proximate to a strut mount of a vane strut, wherein the strut mount extends in a radially outward direction from an airfoil portion of the vane strut, wherein the strut mount forms a hollow semi-cylinder; and disposing an aft mount portion around the flap mount assembly such that the aft mount portion and the strut mount form a strut cylinder with threading on an outer diameter thereof.

13. The method of claim 12, wherein assembling the flap mount assembly includes disposing a bushing around a flap post of a flap such that the flap post is attached to the bushing but rotatable relative to the bushing.

14. The method of claim 13, further comprising disposing a washer between a portion of the bushing and a portion of the flap.

15. The method of claim 13, further comprising securing the flap mount assembly to the strut cylinder by threading a flap spanner nut around the bushing and tightening the flap spanner nut into a flange of the strut cylinder.

16. The method of claim 13, further comprising placing the strut cylinder within a turbomachine housing.

17. The method of claim 16, further comprising securing the strut cylinder to the turbomachine housing by threading a strut spanner nut around the strut cylinder and tightening the strut spanner nut into the turbomachine housing.

18. The method of claim 17, wherein the flap mount assembly is secured to the strut cylinder before the strut cylinder is secured to the turbomachine housing.

19. The method of claim 18, further comprising positioning the flap relative to the vane strut before securing the flap mount assembly to the strut cylinder.

* * * * *